US006695277B1

(12) United States Patent
Gallis

(10) Patent No.: US 6,695,277 B1
(45) Date of Patent: Feb. 24, 2004

(54) MODULAR FORM TUBE AND CLAMP SYSTEM

(75) Inventor: Anthony J. Gallis, Lake Hiawatha, NJ (US)

(73) Assignee: Harsco Technologies Corporation, Fairmont, MN (US)

( * ) Notice: Subject to any disclaimer, the term of this patent is extended or adjusted under 35 U.S.C. 154(b) by 1 day.

(21) Appl. No.: 10/271,908

(22) Filed: Oct. 16, 2002

Related U.S. Application Data

(62) Division of application No. 09/759,895, filed on Jan. 12, 2001.

(51) Int. Cl.[7] ..... E04G 17/075
(52) U.S. Cl. ..... 249/191; 249/217
(58) Field of Search ..... 249/217, 191, 249/193, 45, 46, 47, 192, 194, 219.1

(56) References Cited

U.S. PATENT DOCUMENTS 1,291,257 A * 1/1919 Thompson ..... 249/219.1
1,292,986 A * 2/1919 Ambursen ..... 249/193
1,293,036 A * 2/1919 Church ..... 249/193
1,780,661 A * 11/1930 Wedberg ..... 249/191
2,600,362 A * 6/1952 Harder ..... 249/191
2,610,660 A 9/1952 Jennings et al.
2,763,911 A * 9/1956 Rumble ..... 249/45
3,357,672 A * 12/1967 Capek ..... 249/191
3,945,602 A * 3/1976 Doubleday et al. ..... 249/219.1
4,185,804 A 1/1980 Baculo
4,433,520 A 2/1984 Maschhoff
5,579,624 A 12/1996 Aeberhard
5,855,807 A * 1/1999 Hsieh ..... 249/193
5,860,262 A 1/1999 Johnson
5,965,053 A * 10/1999 Carlson ..... 249/219.1
5,987,830 A 11/1999 Worley

* cited by examiner

*Primary Examiner*—Michael Safavi
(74) *Attorney, Agent, or Firm*—Brij K. Agarwal; Eckert Seamans Cherin & Mellott, LLC

(57) ABSTRACT

A method of constructing a wall form and of forming a wall includes employing a modular concrete form system having a clamping device to clamp adjacent modular form members to one another. The clamping device includes an elongated bar, a pair of clamps mounted on the bar, and a pair of clip assemblies mounted on the bar, the bar being shaped to complementarily engage the perimeter frames of the modular form members. The jaws of the clamps retain the perimeter frames of the adjacent modular form members against the bar, which clamps the form members to the bar and retains them in a flush orientation with one another. The clip assemblies each having a slidable tie clip formed with an opening for receiving a portion of a tie therein. The tie is tapered and is nominally of a circular cross section and formed with a plurality of spaced groves at the alternate ends thereof.

13 Claims, 10 Drawing Sheets

MODULAR FORM TUBE AND CLAMP SYSTEM

CROSS-REFERENCE TO RELATED APPLICATION

The current application is a divisional application of U.S. patent application Ser. No. 09/759,895, filed Jan. 12, 2001, the disclosure of which is incorporated herein by reference.

BACKGROUND OF THE INVENTION

1. Field of the Invention

The present invention relates generally to modular form systems for the pouring of concrete walls and other structures and, more particularly, relates to a clamping device for clamping modular form members with one another. Specifically, the invention relates to a clamping device that can clamp one or more modular form members to a tube that is shaped to complementarily receive the modular form member.

2. Description of the Related Art

Concrete is a well-known building material that has been used for many years. Once particular use of concrete is in the formation of poured concrete walls whereby a hollow form is assembled at a desired location, with concrete then being poured into the form and allowed to harden or cure. As is known in the relevant art, one type of form includes a plurality of panels that are each formed with a retention surface. The panels are affixed to one another such that the retention surfaces together provide an interior surface and an exterior surface that will retain the uncured concrete and that will define the interior and exterior surfaces of the finished concrete wall. Once the poured concrete has cured, the panels are disassembled and removed from the wall and are reused in other applications to build other such walls. While such known modular form systems have been at least moderately successful for their intended purposes, such known systems have not, however, been without limitations.

Such known concrete modular form systems are labor-intensive to assemble as well as to disassemble after the wall has been formed. Moreover, the formation of walls using known modular form systems is expensive in terms of assembly components that remain disposed in the finished wall and thus cannot be reused.

The modular form members typically include a perimeter frame that is formed with a number of slots that receive wedge bolts and/or tie members for assembling the modular form members into a wall form. As is known in the relevant art, wedge bolts typically are roughly triangular plates formed with a longitudinally extending slot. One way in which wedge bolts can be used to assemble adjacent form members to one another is to align the slots of the adjacent perimeter frames and to receive a first wedge bolt in the aligned slots until the wedge bolt is wedged therein. A second wedge bolt is then received in the slot formed in the first wedge bolt to compress the form members against one another. Such assembly practices require the use of numerous such wedge bolts that often must be assembled and disassembled with a hammer, which is extremely time consuming and thus is costly in terms of labor.

Tie members are employed to extend between the form members that will form the interior surface of the wall and the form members that will form the exterior surface of the wall, as well as for other purposes. Such tie members extend directly between opposed pairs of aligned form members and other structures and thus ultimately are disposed within the concrete when the concrete is poured as well as after curing thereof. As such, many such tie members remain disposed internally within a cured concrete wall and thus cannot be reused. Tie members often are attached to the modular form members with additional wedge bolts, which requires substantial increased labor.

After the concrete has cured and the form members are removed from the concrete walls, the ends of the tie members typically protrude outwardly from the wall and must be removed, as by snapping off the protruding portion, which requires further labor. In this regard, it can be seen that the use of tie members extending between the interior and exterior form members requires the attention of a laborer at both of the interior and exterior walls for the application and removal of wedge bolts or other attachment structures.

It is thus desired to provide an improved modular form system that permits adjacent form members to be connected with one another quickly and efficiently with reduced labor required. Additionally, it is desired to provide such an improved system that does not require the usual labor-intensive efforts to install tie members between interior and exterior form members. Still further, it is desired to provide such a system wherein fewer, if any, tie members remain within the concrete wall after curing.

SUMMARY OF THE INVENTION

A modular concrete form system employs a clamping device to clamp adjacent modular form members to one another. The clamping device includes an elongated bar and a pair of clamps mounted on the bar, the bar being shaped to complementarily engage the perimeter frames of the modular form members. The jaws of the clamps retain the perimeter frames of the adjacent modular form members against the bar, which clamps the form members to one another and retains them in a flush orientation with one another.

The clamping system additionally includes a pair of clip assemblies mounted on the bar, the clip assemblies each having a slidable tie clip formed with an opening for receiving a portion of a tie therein. The tie is tapered and is nominally of a circular cross section and formed with a plurality of spaced groves at the alternate ends thereof. One end of the tie is receivable in a tie hole formed in the bar as well as in an opening of a tie clip that is aligned with the tie hole, the grooves in the end of the tie being removably lockable in the opening. The opposite end of the tie can be similarly received in another clamping device that is used to clamp modular form members that will define an opposite surface of a concrete wall. The ties are disposed within the wall after the concrete has cured, but the ties are nevertheless removable from the cured concrete inasmuch as the ties are tapered and can be dislodged from the wall with a blow from a hammer delivered to the narrow protruding end of the tie.

One embodiment of the present invention provides a clamping device for retaining a first modular form member in a given orientation with respect to a second modular form member, the first modular form member being formed with a first indentation, the second modular form member being formed with a second indentation, the general nature of which can be stated as including an elongated bar having a first protrusion and a second protrusion, the first protrusion being structured to be engageable with the first indentation, the second protrusion being structured to be engageable with the second indentation, and at least a first clamp having a first jaw and a second jaw, the first jaw being structured to removably engage the first protrusion with the first indentation, the second jaw being structured to removably engage the second protrusion with the second indentation.

Another embodiment of the present invention provides a retention system for retaining a first modular form member in a given orientation with respect to a second modular form member, the first modular form member being formed with a first indentation, the second modular form member being formed with a second indentation, the general nature of which can be stated as including a first clamping device, a second clamping device, and an elongated tie, the first clamping device including a first elongated bar having at least a first protrusion, at least a first clamp, and at least a first tie clip, the at least first protrusion being structured to be engageable with the first indentation, the at least first clamp having a jaw, the jaw of the at least first clamp being structured to removably engage the first protrusion with the first indentation, the at least first tie clip being mounted on the first bar and being formed with an opening that is configured to removably receive at least a portion of the tie therein, and the second clamping device including a second elongated bar having at least a second protrusion, at least a second clamp, and at least a second tie clip, the at least second protrusion being structured to be engageable with the second indentation, the at least second clamp having a jaw, the jaw of the at least second clamp being structured to removably engage the second protrusion with the second indentation, the at least second tie clip being mounted on the second bar and being formed with an opening that is configured to removably receive at least a portion of the tie therein.

Still another embodiment of the present invention provides a clamping device for retaining a first modular form member in a given orientation with respect to a second modular form member, the first modular form member being formed with a first form engagement structure, the second modular form member being formed with a second form engagement structure, the general nature of which can be said to includes an elongated bar having a first bar engagement structure and a second bar engagement structure, the first bar engagement structure being structured to be engageable with the first form engagement structure, the second bar engagement structure being structured to be engageable with the second form engagement structure, and at least a first clamp having a first jaw and a second jaw, the first jaw being structured to removably engage the first bar engagement structure with the first form engagement structure, the second jaw being structured to removably engage the second bar engagement structure with the second form engagement structure.

An object of the present invention is to provide a clamping device having a bar and a clamp that can clamp a modular form member to the bar.

A further object of the present invention is to provide a modular form system that employs ties that are tapered and removable from a cured concrete wall.

A further object of the present invention is to provide a clamping device that employs sliding tie clips formed with openings that can receive grooved ends of ties therein.

A further object of the present invention is to provide a clamping device having an elongated bar that is formed to complementarily engage a perimeter frame of a modular form member.

A further object of the present invention is to provide a clamping device that is compatible with and can be used in conjunction with existing modular form systems.

A further object of the present invention is to provide a clamping device and a modular form system that are economical to use.

A further object of the present invention is to provide a clamping device that improves the efficiency with which a modular form system can be used.

A further object of the present invention is to provide a method of constructing a wall form that can be used to construct a wall out of a building material such as concrete.

A further object of the present invention is to provide a method of forming a wall out of a building material.

These and other objects and advantages of the present invention will be more readily understood from the following description and reference to the drawings.

BRIEF DESCRIPTION OF THE DRAWINGS

The preferred embodiments of the invention, illustrative of the best modes in which Applicant has contemplated applying the principles of the invention, are set forth in the following description and are shown in the drawings and are particularly and distinctly pointed out and set forth in the appended Claims.

Similar numerals refer to similar parts throughout the specification.

DESCRIPTION OF THE PREFERRED EMBODIMENTS

Figure 1:
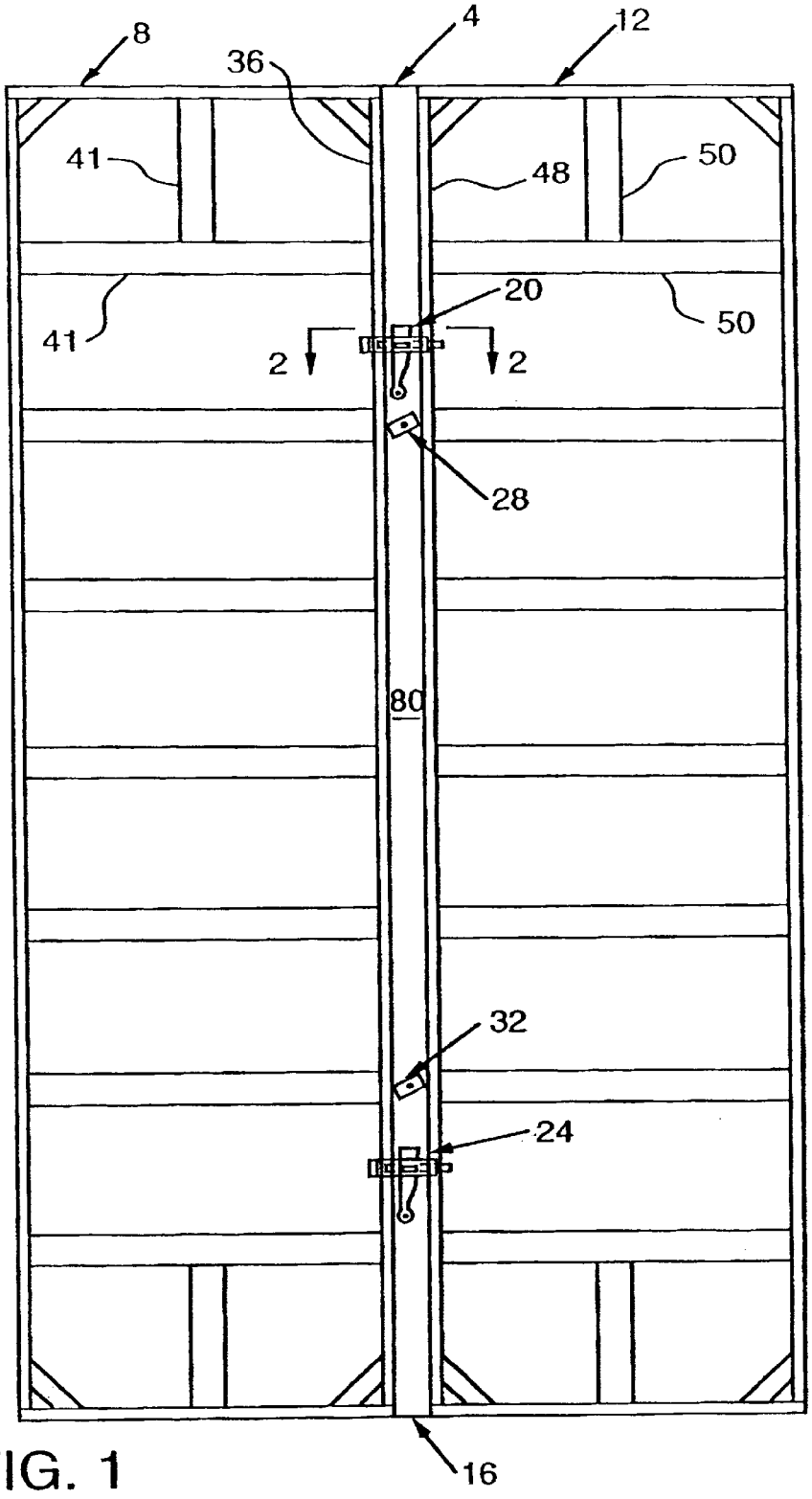
FIG. 1 is a front elevational view of a clamping device in accordance with the present invention to which are connected a pair of modular form members on alternate sides thereof.

A first embodiment of a clamping device 4 in accordance with the present invention is indicated in generally FIGS. 1–9C. The clamping device 4 is employed to clamp a first modular form member 8 to a second modular form member 12. A plurality of modular form members such as the first and second modular form members 8 and 12, and a plurality of the clamping devices 4, are employed to assemble a wall form 14 (FIG. 1A ) into which uncured concrete will be poured to create a finished concrete wall.

Figure 1A:
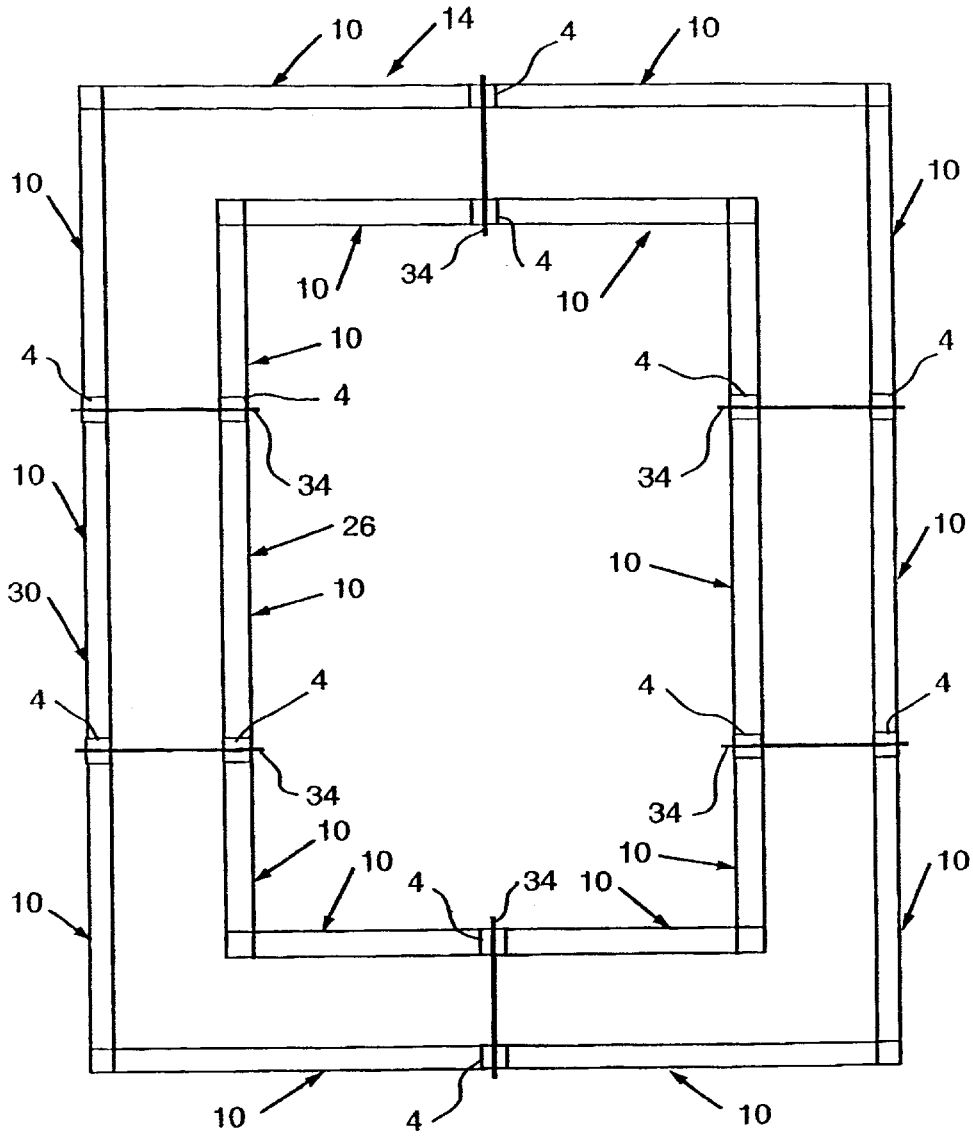
FIG. 1A is a schematic top plan representation of a simple wall form employing the clamping device of the present invention.

The wall form 14 depicted generally in FIG. 1A is very simple, and it is understood that the modular form members employed to construct the wall form 14, which are indicated generally by the numeral 10, can be of dimensions other than those of the first and second modular form members 8 and 12. The modular form members 8 and 12 depicted in FIG. 1 are presented herein as an example of one application of the present invention.

As is best shown in FIG. 1, the clamping device 4 includes an elongated bar 16, a first clamp 20 and a second clamp 24 mounted on the bar 16, and a first clip assembly 28 and a second clip assembly 32 mounted on the bar 16. As will be set forth more fully below, the first and second clamps 20 and 24 removably clamp the first and second modular form members 8 and 12 against the bar 16, and the first and second clip assemblies 28 and 32 cooperate with ties 34 (FIGS. 1A and 6) that extend between and retain opposite clamping devices 4 in a fixed position with respect to one another in constructing the wall form 14. The clamping device 4 may be manufactured out of a metal such as steel, aluminum, or other appropriate metals. Alternatively, or in addition thereto, the clamping device 4 may be wholly or partially manufactured out of appropriate non-metallic materials such as plastic, rubber, resinous compounds, and other such materials. Such non-metallic materials may additionally be combined with fibers or other structures of glass, carbon, aramid, or other such materials.

As can be seen in FIG. 1A, a plurality of the clamping devices 4 and a plurality of the modular form members are employed to construct the wall form 14. The wall form 14, in the example shown herein, includes clamping devices 4 and modular form members 10 to form an interior structure 26 and other clamping devices 4 and modular form members 10 to form an exterior structure 30. After uncured concrete is poured between the interior and exterior structures 26 and 30, the interior structure 26 will define the interior wall of the finished concrete wall and the exterior structure 30 will define the exterior wall.

With reference to FIG. 1, it can be seen that the first and second modular form members 8 and 12 are each substantially rectangular members, and it is understood that they are substantially identical to one another. The first modular form member 8 includes a first perimeter frame 36 that extends peripherally about and carries a generally planar first panel 40. The first perimeter frame 36 also includes a plurality of cross members 41 that provide strength and rigidity to the first perimeter frame 36. The second modular form member 12 similarly includes a second perimeter frame 48 that extends peripherally about and carries a generally planar second panel 52, the second perimeter frame 48 including a plurality of cross members 50.

Figure 2:
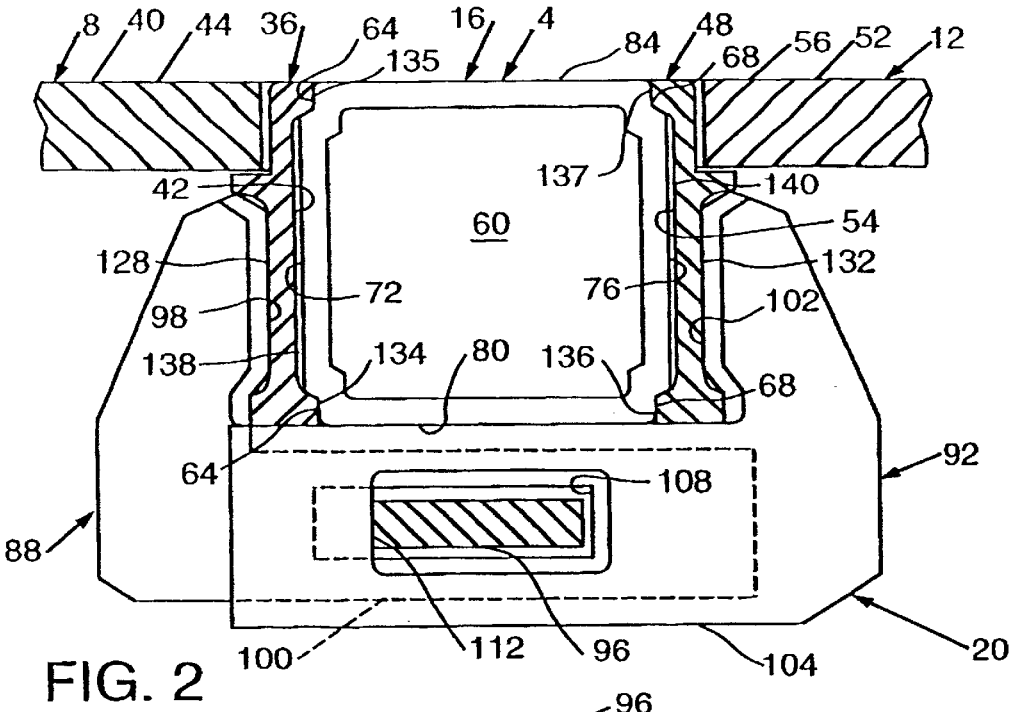
FIG. 2 is a sectional view as taken along line 2—2 of FIG. 1.

As is best shown in FIG. 2, the first perimeter frame 36 includes an inwardly directed first indentation 42 that extends substantially continuously along the longitudinal extent of the first perimeter frame 36. The first panel 40 includes a substantially planar first retention surface 44 against which the uncured concrete will be poured during construction of the finished concrete wall.

FIG. 2 further illustrates that the second perimeter frame 48 is formed with an inwardly directed second indentation 54 that extends substantially continuously throughout the longitudinal extent of the second perimeter frame 48. The second panel 52 similarly includes a substantially planar second retention surface 56 against which the uncured concrete will be poured and will be retained.

It can also be seen from FIG. 2 that the bar 16 is a hollow member formed with an elongated passageway 60 extending longitudinally therethrough. Depending upon the material out of which the bar 16 is manufactured, it may be desirable to manufacture the bar 16 without the passageway 60, as will be set forth more fully below.

The bar 16 additionally includes a pair of elongated first embossments 64 on one side of the bar 16 and a pair of elongated second embossments 68 extending along an opposite side of the bar 16. The first and second embossments 64 and 68 extend into the bar 16 and extend substantially continuously along the longitudinal extent of the bar 16. As will be set forth more fully below, however, in other embodiments the first and second embossments 64 and 68 may not extend continuously along the longitudinal extent of the bar 16, and rather may be made up of a plurality of smaller bumps or other forms that are spaced from one another but are aligned with one another along the longitudinal extent of the bar 16. It will also be understood that the terms "embossment" and variations thereof are used herein without limitation as to a specific method of manufacture or forming, as will be set forth more fully below.

The first embossments 64 define a first protrusion 72 that extends outwardly from the bar 16 and extends substantially along the longitudinal extent of the bar 16. Similarly, the second embossments 68 define a second protrusion 76 that extends outwardly from the bar 16 in a direction generally away from the first protrusion 72 and extends along substantially the longitudinal extent of the bar 16.

As will be set forth more fully below, the first protrusion 72 is structured to be clampingly and removably received in and engaged with the first indentation 42 formed in the first perimeter frame 36. Similarly, the second protrusion 76 is configured to be clampingly and removably received in and engaged with the second indentation 54 of the second perimeter frame 48. It will be understood, however, that the terms "indentation," "protrusion," and variations thereof are not used in a limiting sense, and rather refer to engagement structures on the bar 16 and on the first and second modular form members 8 and 12 that are complementarily engageable with one another. As such, in other configurations of the present invention the bar 16 may be formed with indentations and the perimeter frames 36 and 48 formed with protrusions without departing from the concept of the present invention.

The bar 16 also includes a generally planar mounting surface 80 extending between the first and second protrusions 72 and 76. The first and second clamps 20 and 24 and the first and second clip assemblies 28 and 32 are mounted on the mounting surface 80. The bar 16 additionally includes a substantially planar facing surface 84 opposite the mounting surface 80. As can be seen in FIG. 2, when the first and second modular form members 8 and 12 are clampingly mounted on the clamping device 4, the facing surface 84 is flush with the first and second retention surfaces 44 and 56, which advantageously provides a substantially smooth and continuous surface for receiving the uncured concrete that will be poured into the wall form 14 during construction of the concrete wall.

Figure 3:
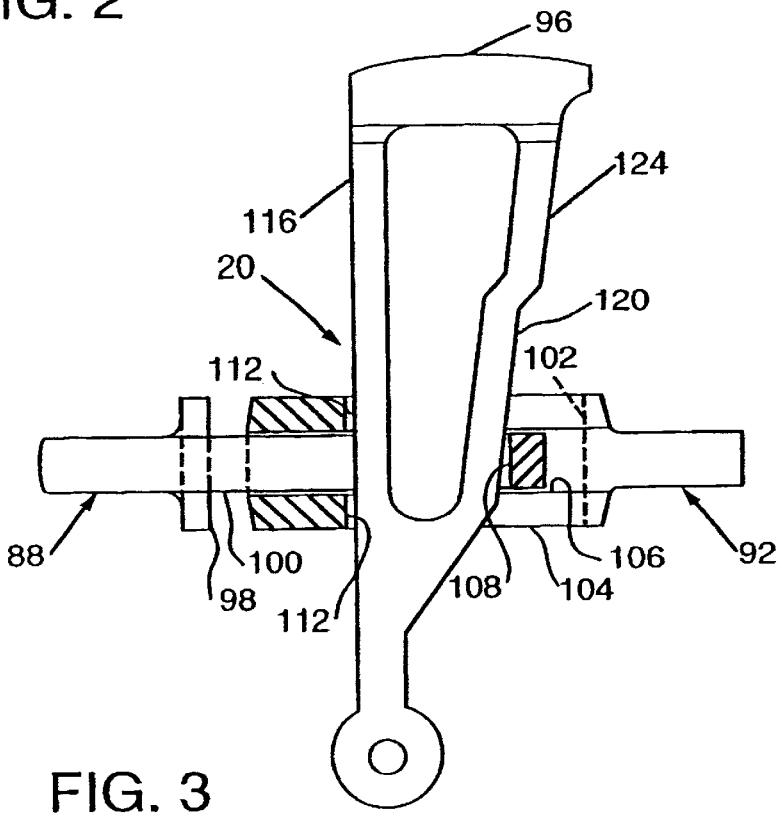
FIG. 3 is an enlarged front elevational view, partially cut away, of a first clamp of the clamping assembly of the present invention.

As can be seen in FIGS. 2 and 3, the first clamp 20 includes a first jaw 88, a second jaw 92, and a clamp bolt 96. Inasmuch as the second clamp 24 is of a substantially identical configuration to the first clamp 20, only the first clamp 20 will be described herein, it being understood that the second clamp 24 possesses the same configuration.

The first jaw 88 includes a first clamping face 98 and a first shank 100 extending substantially perpendicularly from one another. The second jaw 92 includes a second clamping face 102 and a second shank 104 extending substantially perpendicularly from one another. The second shank 104 is formed with a channel 106 extending substantially the length thereof and within which the first shank 100 is slidably received. The sliding adjustment of the first shank 100 in the channel 106 adjusts the distance between the first and second clamping faces 98 and 102, as will be set forth more fully below.

The first shank 100 additionally is formed with a hole that defines first compression surface 108, and the second shank 104 is formed with a hole that defines a pair of co-planar second compression surfaces 112. As is best shown in FIG. 3, the clamp bolt 96 includes a substantially planar vertical surface 116 that is slidably receivable against the second compression surfaces 112, and further includes a first inclined surface 120 and a second inclined surface 124 that are non-parallel with the vertical surface 116 and are adjustably receivable against the first compression surface 108. The first and second inclined surfaces 120 and 124 are oriented at substantially equal angles with respect to the vertical surface 116, although the first and second inclined surfaces 120 and 124 are offset and non-contiguous with one another for use in different applications, as will be set forth more fully below. It will be understood, however, that in alternate embodiments the clamp bolt 96 may be of a greater length than that depicted herein, and thus be configured with only a single inclined surface that is non-parallel with the vertical surface 116 and includes both the first and second inclined surfaces 120 and 124 thereon, whereby the first and second inclined surfaces 120 and 124 would be contiguous with one another and not offset.

As can be understood from FIGS. 2 and 3, as to the first jaw 88, that the first compression surface 108 is generally opposite the first clamping face 98. Similarly, and as to the second jaw 92, the second compression surfaces 112 are generally opposite the second clamping face 102. As the clamp bolt 96 is advanced between the first compression surface 108 and the second compression surfaces 112, the angular offset of the first inclined surface 120 with respect to the vertical surface 116 forces the first compression surface 108 away from the second compression surfaces 112. Such action thus has the effect of drawing the first and second clamping faces 98 and 102 toward one another. As such, when the clamp bolt 96 is advanced in the downward direction with respect to FIG. 3, the first and second clamping faces 98 and 102 are clampingly received toward one another.

Such a configuration of the first clamp 20 is particularly useful with regard to the clamping device 4. As is best shown in FIG. 2, the first perimeter frame 36 additionally includes a first reception surface 128 opposite the first indentation 42 and into which the first clamping face 98 can be received. Similarly, the second perimeter frame 48 includes a second reception surface 132 opposite the second indentation 54 and into which the second clamping face 102 can be received.

In order to clamp the first and second modular form members 8 and 12 with the clamping device 4, the clamp bolt 96 is removed from the first and second jaws 88 and 92, and the first and second jaws 88 and 92 are slid apart to maximize the distance between the first and second clamping faces 98 and 102. A similar operation is performed with the second clamp 24. The first modular form member 88 is then received against the bar 16 such that the first protrusion 72 of the bar 16 is engaged with the first indentation 42 of the first perimeter frame 36. The second modular form member 12 is then received against the bar 16 such that the second protrusion 76 of the bar 16 is engaged with the second indentation 54 of the second perimeter frame 48. The first and second jaws 88 and 92 are then manually pushed together to bring the first and second clamping faces 98 and 102 toward one another and, more specifically, to receive the first clamping face 98 in the first reception surface 128 and to receive the second clamping face 102 in the second reception surface 132.

The clamp bolt 96 is then received with the vertical surface 116 disposed against the second compression surfaces 112 and with one of the first and second inclined surfaces 120 and 124 disposed against the first compression surface 108. The clamp bolt 96 is received as such with sufficient force to compressively engage the first and second clamping faces 98 and 102 against the first and second reception surfaces 128 and 132, and thereby to compressively retain the first and second perimeter frames 36 and 48 against the bar 16.

In alternate applications in which only the first modular form member 8 is to be clamped to the bar 16, such as at the end of a long wall where a bulkhead is to be positioned opposite the first modular form member 8 where the second modular form member 12 otherwise would be, the second inclined surface 124 is provided to take up the additional slack between the first and second clamping faces 98 and 102 in the absence of the second perimeter frame 48. The second inclined surface 124 is also usable in other applications of the clamping device 4.

As is best shown in FIG. 2, the first perimeter frame 36 includes a pair of first extension members 134 and 135 that are disposed on alternate sides of the first indentation 42 and that extend outwardly therefrom. It can further be seen that the first perimeter frame 36 includes angled or arcuate fillets that form the transition from the first indentation 42 to the first extension members 134 and 135.

When the first modular form member 8 is compressed against the bar 16, the first extension members 134 and 135 are received in the first embossments 64, and the edges of the first protrusion 72 are engaged with the fillets between the first indentation 42 and the first extension members 134 and 135. Such engagement advantageously resists movement of the first modular form member 8 with respect to the bar 16 that otherwise might permit the first retention surface 44 to become non-coplanar with the facing surface 84.

It can be seen that the depth of the first indentation 42 is at least nominally greater than the height of the first protrusion 72 such that a first cavity 138 remains between the first indentation 42 and the first protrusion 72 when the first modular form member 8 is clamped against the bar 16. The first cavity 138 advantageously can receive foreign matter therein that otherwise might interfere with the clamping engagement of the first protrusion 72 with the first indentation 42. The reception of the first extension members 134 and 135 in the first embossments 64 with the first cavity 138 extending therebetween thus provides two relatively smaller regions of contact between the first modular form member 8 and the bar 16 instead of having a relatively larger single surface of contact. Such a configuration helps to alleviate the effect of nominal quantities of foreign matter that may be received between the first protrusion 72 and the first indentation 42, which helps to ensure that the first retention surface 44 is coplanar with the facing surface 84 when the first modular form member 8 is clamped to the bar 16.

The second perimeter frame 48 is similarly formed with a pair of second extension members 136 and 137 and similar fillets that are received in the second embossments 68 and engaged with the second protrusion 76 of the bar 16, with a second cavity 140 remaining between the second indentation 54 and the second protrusion 76. Such a configuration similarly provides two relatively smaller regions of contact between the second modular form member 12 and the bar 16 to ensure that the second retention surface 56 is coplanar with the facing surface 84 when the second modular form member 12 is clamped against the bar 16, and alleviates the effect of nominal quantities of foreign matter that may be received between the second protrusion 76 and the second indentation 54.

It can thus be seen that the first and second modular form members 8 and 12 can be quickly clamped against the bar 16 by operating the first and second clamps 20 and 24 as set forth above. In this regard, it can be see that the labor involved in operating the first and second clamps 20 and 24 is substantially less than would be required if a plurality of prior art wedge bolts as described above were employed in clamping the first and second modular form members 8 and 12 together. Moreover, the configuration of the bar 16 with the first and second embossments 64 and 68 that define the first and second protrusions 72 and 76 that operate complementarily with the first and second perimeter frames 36 and 48 helps to automatically align the first and second modular form members 8 and 12 with the bar 16 and with one another upon clamping the first and second modular form members 8 and 12 to the bar 16. It can thus be seen that the clamping device 4 quickly and reliably clamps the first modular form member 8 into a desired orientation with respect to the second modular form member 12, whereby the first and second retention surfaces 44 and 56 are coplanar with one another and with the facing surface 84 of the bar 16 to advantageously provide a common planar surface against which concrete can be formed and retained in forming a concrete wall.

Figure 4:
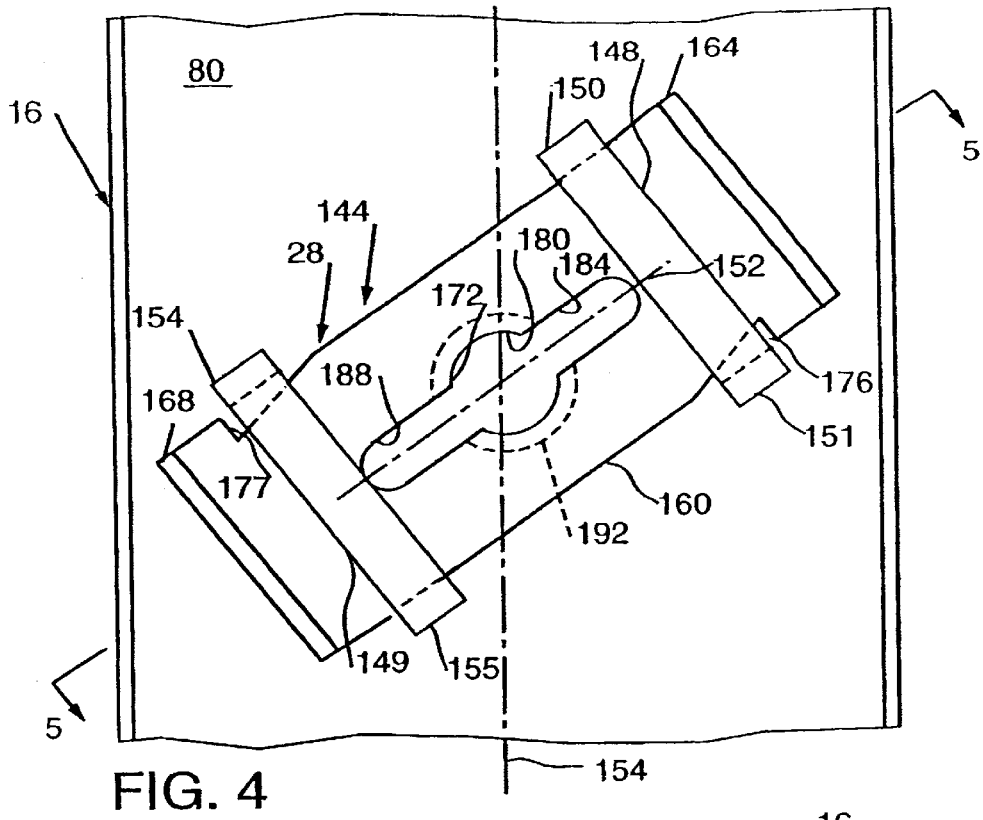
FIG. 4 is an enlarged front elevational view of a first clip assembly of the clamping device of the present invention.

As is best shown in FIGS. 1 and 4, the first and second clip assemblies 28 and 32 are disposed on the mounting surface 80 between the first and second clamps 20 and 24. It is understood, however, that different arrangements of the first and second clamps 20 and 24 and the first and second clip assemblies 28 and 32 are possible without departing from the concept of the present invention. Inasmuch as the first and second clip assemblies 28 and 32 are virtually of identical configurations, only the first clip assembly 28 will be described in detail hereafter, it being understood that the second clip assembly 32 is substantially identical thereto.

As is best shown in FIG. 4, the first clip assembly 28 includes a tie clip 144 and a pair of straps 148 and 149. The opposite ends 150, 151, 154, and 155 of the straps 148 and 149 are fixedly mounted on the mounting surface 80 such as by welding or other attachment methodology. The portions of the straps 148 and 149 between the ends 150, 151, 154, and 155 slidably retain the tie clip 144 against the mounting surface 80. The tie clip 144 is slidable along a sliding axis 152 that is angled with respect to a longitudinal axis 156 of the bar 16.

Figure 5:
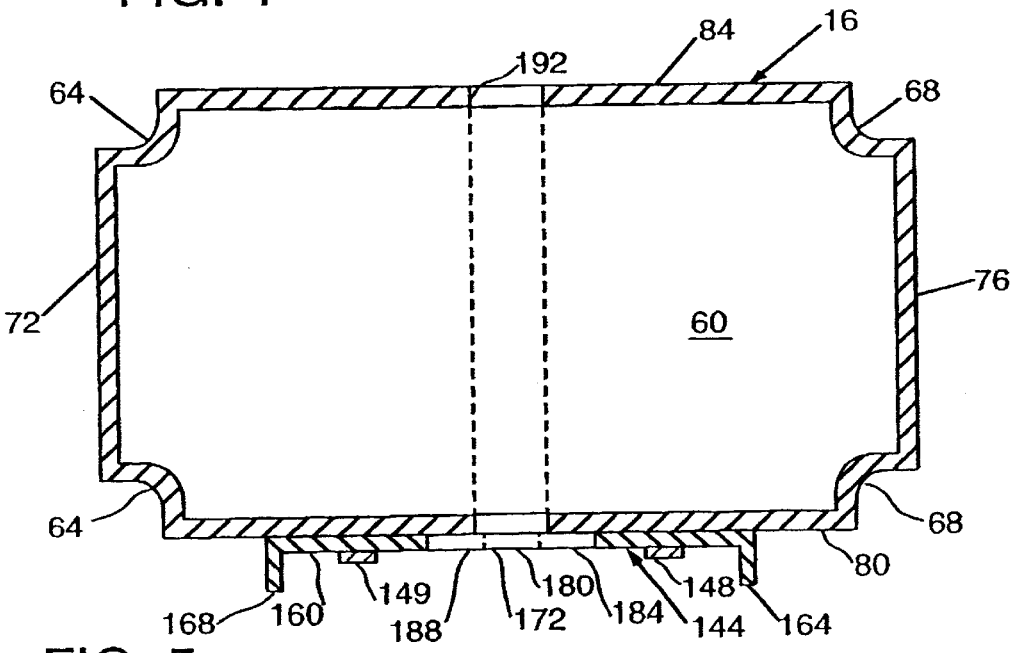
FIG. 5 is a cross-sectional view as taken along line 5—5 of FIG. 4.

As is best shown in FIG. 5, the tie clip 144 includes a substantially planar plate 160, a first ear 164, and a second ear 168. The first and second ears 164 and 168 are disposed at the alternate ends of the plate 160 and protrude perpendicularly outward from the plane of the plate 160 in a direction generally away from the mounting surface 80 of the bar 16. While it can be seen that the tie clip 144 is slidable along the sliding axis 152 with respect to the bar 16, such sliding movement of the tie clip 144 is nevertheless limited by the straps 148 and 149 and, more specifically, by the engagement of either of the first and second ears 164 and 168 with either of the straps 148 and 149. The first and second ears 164 and 168 not only limit the movement of the tie clip 144 with respect to the bar 16, but also protrude outwardly from the plate 160 and thus can receive a blow from an appropriate tool, such as a hammer, at appropriate times should the tie clip 144 become stuck or locked with respect to the bar 16.

With continued attention to FIG. 4, it can be seen that the plate 160 is formed with a central opening 172 and a pair of diagonally opposed notches 176 and 177. The opening 172 includes an approximately circular central hole 180 from which extend an elongated first slot 184 and an elongated second slot 188, the first and second slots 184 and 188 extending longitudinally along the sliding axis 152 in opposite directions from one another.

As can be seen in FIGS. 4 and 5, the bar 16 is formed with a first tie hole 192 extending therethrough midway between the first and second protrusions 72 and 76. Inasmuch as the bar 16 of the first embodiment is a hollow member formed with the passageway 60 extending longitudinally therethrough, the first tie hole 192 includes axially aligned holes that extend into the bar 16 from the mounting and facing surfaces 80 and 84 to define the first tie hole 192 that extends through the bar 16.

As is best shown in FIG. 4, the first tie hole 192 extends through the intersection between the sliding axis 152 of the tie clip 144 and the longitudinal axis 156 of the bar 16. It can likewise be seen that the hole 180 of the opening 172 formed in the plate 160 is axially alignable with the first tie hole 192.

Figure 9A:
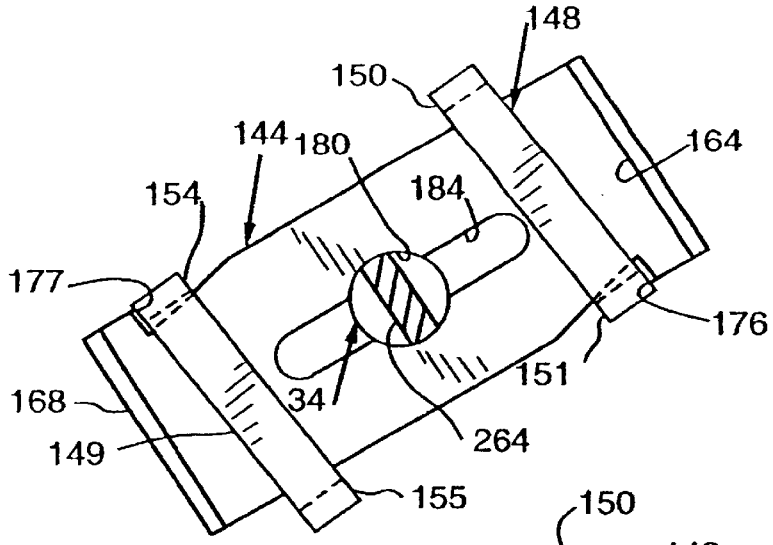
FIG. 9A is a front elevational view of a first end of the tie received in an opening in the clip assembly.

The notches 176 and 177 are receivable against the ends 151 and 154 of the straps 148 and 149 when the hole 180 is aligned with the first tie hole 192. More specifically, and as is shown in FIG. 9A, when the hole 180 is aligned with the first tie hole 192, the tie clip 144 can be rotated slightly in a clockwise fashion to cause the notches 176 and 177, which are angularly undercut into diagonally opposed regions of the plate 160, to engage diagonally opposed ends 151 and 154 of the straps 148 and 149. It is understood, however, that other configurations for the notches 176 and 177 are possible without departing from the concept of the present invention.

Inasmuch as the tie clip 144 is slidably disposed between the central portions of the straps 148 and 149 and the mounting surface 80 of the bar 16, the engagement of the notches 176 and 177 against the ends 151 and 154 of the straps 148 and 149 retains the hole 180 in substantial alignment with the first tie hole 192 by resisting the tie clip 144 from gravitationally sliding along the sliding axis 152.

Such alignment between the hole 180 in the plate 160 and the first tie hole 192 is desirable inasmuch as such alignment permits the tie 34 (FIG. 6) to be received in the first hole 192 and through the hole 180 in the plate 160, as will be set forth more fully below. In this regard, it is understood that the bar 16 is further formed with a second tie hole that is alignable with a similar hole formed in a tie clip of the second clip assembly 32 that is also disposed on the bar 16.

Figure 6:
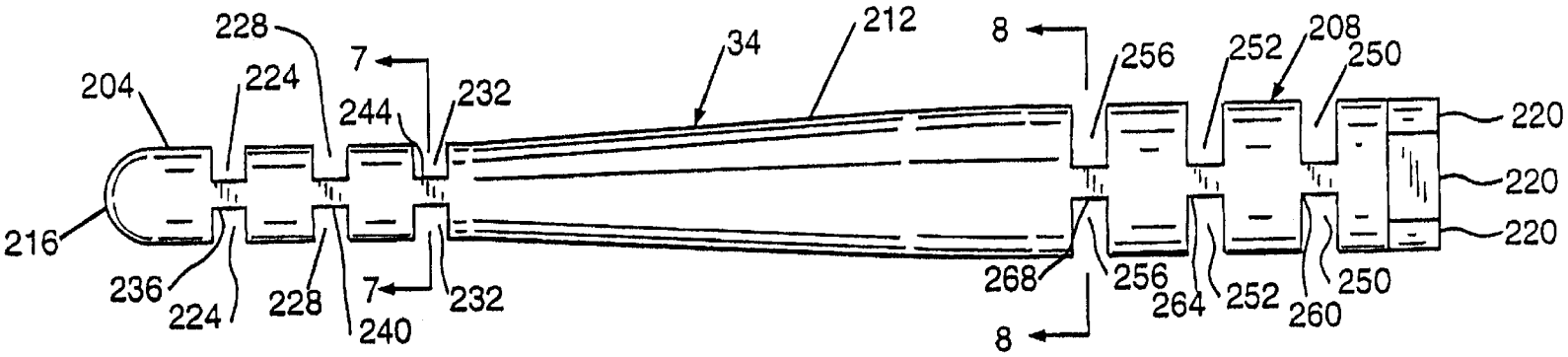
FIG. 6 is a top plan view of a tie in accordance with the present invention.
Figure 7:
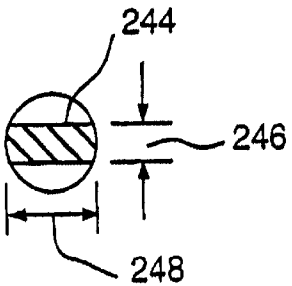
FIG. 7 is a cross-sectional view as taken along line 7—7 of FIG. 6.
Figure 8:
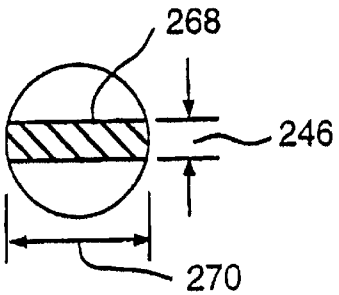
FIG. 8 is a cross-sectional view as taken along line 8—8 of FIG. 6.

The tie 34 is depicted generally in FIGS. 6 through 8. In assembling the wall form 14 it is understood that a plurality of the ties 34 will be employed, and as will be set forth more fully below the ties 34 each extend between a pair of opposed clamping devices 4.

The tie 34 is an elongated member having a nominally circular cross section and including a first end 204, a second end 208, and a central region 212 extending between the first and second ends 204 and 208. As can be seen in FIG. 6, the central region 212 is tapered inwardly from the second end 208 to the first end 204 for purposes that will be set forth more fully below. The second end 208 thus is of a greater diameter than the first end 204. The first and second ends 204 and 208 are each non-tapered, although in other configurations either or both of the first and second ends 204 and 208 potentially can be tapered without affecting the concept of the present invention. It is also understood that the tie 34 depicted in FIG. 6 is exaggerated in width and is shortened in length for purposes of clarity.

With continued attention to FIG. 6, it can be seen that the longitudinally outermost portion of the first end 204 is a rounded tip 216. The rounded tip 216 facilitates insertion of the first end 204 into the hole 180 and the first tie hole 192 during assembly of the wall form 14. It can also be seen that the longitudinally outermost portion of the second end 208, which is opposite the rounded tip 216, includes a plurality of flats 220 arranged in a hexagonal configuration to receive a wrench or other tool to facilitate rotation of the tie 34 about its central axis. It is understood, however, that the flats 220 could be replaced with other appropriate structures such as an internally wrenching head that can receive an appropriate tool therein.

The first end 204 is formed with a pair of diametrically opposed first grooves 224, a pair diametrically opposed second grooves 228, and a pair of diametrically opposed third grooves 232. The first grooves 224 thus define a first key 236 on the tie 34, and the second and third grooves 228 and 232 similarly define a second key 240 and a third key 244 (FIG. 7), respectively. In this regard, it can be seen that the first, second, and third grooves 224, 228, and 232 refer to material that has been removed from the first end 204, while the first, second, and third keys 236, 240, and 244 refer to material that remains with the first end 204 and is defined by the first, second, and third grooves 224, 228, and 232, respectively. The keys and grooves define retention structures that are receivable in the openings 172 of the tie clips 144, as will be set forth more fully below.

The first, second, and third keys 236, 240, and 244 are all of an equal key width 246 as measured across the parallel and spaced apart planar surfaces of the first, second, and third keys 236, 240, and 244. The first, second, and third keys 236, 240, and 244 each also have a key length 248 that is defined by the nominal circular diameter of the first end 204.

The second end 208 is similarly formed with a pair of first grooves 250, a pair of second grooves 252, and a pair of third grooves 256, the first, second, and third pairs of grooves 250, 252, and 256 defining a first key 260, a second key 264, and a third key 268 (FIG. 8), respectively. It can be seen that the first, second, and third keys 260, 264, and 268 each advantageously are of the same key width 246, as measured across the parallel and spaced apart planar surfaces thereof, as the first, second, and third keys 236, 240, and 244 of the first end 204. The first, second, and third keys 260, 264, and 268 have a key length 270 defined by the nominal circular diameter of the second end 208.

As can be seen in FIG. 1A, in constructing the wall form 14 a plurality of modular form members 10 are clamped to a plurality of clamping devices 4, and a pair of ties 34 extend between each opposed pair of clamping devices 4. Inasmuch as the insertion of each of the ties 34 between opposed pairs of clamping devices 4 is substantially similar, the insertion of only a single tie 34 will be illustrated herein, it being understood that the insertion process is repeated for additional ties 34 as needed.

While not specifically shown in FIG. 1A, it is understood that the clamping devices 4 depicted therein are positioned such that the facing surfaces 84 of opposed pairs of the clamping devices 4 face one another, and that the mounting surfaces 80 that carry the first and second clamps 20 and 24 as well as the first and second clip assemblies 28 and 32 face away from one another. In beginning the installation of the tie 34, it is desired that the tie clips 144 of each clamping device 4 be rotated as shown in FIG. 9A such that the notches 176 and 177 thereof engage the ends 151 and 154 of the straps. The installation of the ties 34 between the opposed pairs of the clamping devices 4, which is described immediately hereafter, is carried out by a laborer standing beside either of the interior or exterior structures 26 or 30, it being substantially unnecessary for a laborer to work from both of the interior and exterior structures 26 and 30.

The first end 204 of the tie 34 is axially inserted into the hole 180 in the plate 160 and thereafter through the first tie hole 192 of a first clamping device 4. In such condition the tie 34 is partially received in the first clamping device 4, with the rounded tip 216 of the tie 34 extending into the space in the wall form 14 between the interior and exterior structures 26 and 30.

The tie 34 is further axially advanced toward the second clamping device 4 until the rounded tip 216 of the first end 204 is received through the first tie hole 192 of a second and opposed clamping device 4, with the tie 34 being further advanced until the rounded tip 216 passes through the hole 180 in the opposing tie clip 144. In such condition, the tie 34 extends between the first and second clamping devices 4, with the first end 204 extending through the second clamping device 4 and with the second end 208 extending through the first clamping device 4. In such condition, the tie 34 is rotationally aligned such that the longest dimensions of the first, second, and third keys 236, 240, 244, 260, 264, and 268 lie in a direction substantially perpendicular to the sliding axis 152 of th,e tie clips 144.

In order to enhance the versatility of the present invention, the first tie holes 192 and the holes 180 in the tie clips 144 are sized to receive therein the part of the tie 34 having the largest diameter, which in the depicted embodiment is the second end 208. Such a configuration obviates the likelihood of needing to consciously assemble the wall form 14 with specific parts on the interior structure 26 and other parts on the exterior structure 30, which advantageously simplified assembly.

The tie 34 must then be translated to a specific longitudinal position with respect to both of the tie clips 144. More specifically, the first, second, and third grooves 224, 228, 232, 250, 252, and 256 are longitudinally spaced from one another along the tie 34 to allow for finished walls having different thicknesses. For instance, the distance between the third grooves 232 and 256 is representative of the minimum wall thickness that can result in employing the tie 34 to build the wall form 14. Similarly, the distance between the first grooves 224 and 250 represents the maximum wall thickness. It must be decided during assembly of the wall form 14 which sets of grooves will be employed on the tie 34 to insure that a consistent and appropriate wall thickness results in the finished wall.

Once the tie 34 has achieved an appropriate alignment with respect to the tie clips 144 of the clamping devices 4 such that one of the first, second, and third keys 236, 240, and 244 is aligned with the hole 180 in the tie clip 144 of the second clamping device 4, and one of the first, second, and third keys 260, 264, and 268 is aligned with the hole 180 in the tie clip 144 of the first clamping device 4, the tie 34 is rotated about its central axis until the key widths 246 are aligned with the first slots 184 of the tie clips 144. In this regard, the flats 220 may be employed in conjunction with an appropriate tool to rotate the tie 34.

Figure 9B:
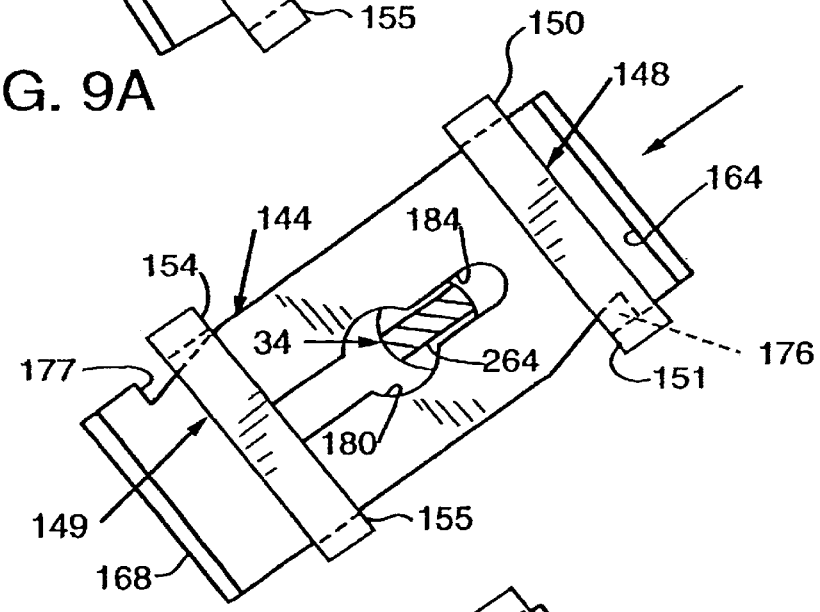
FIG. 9B is a view similar to FIG. 9A, except showing the tie rotated such that a retention structure formed in the tie is partially received in a slot formed in the tie clip.

As can be seen in FIG. 9B, such rotation of the tie 34 in a counter-clockwise direction results in the tie clips 144 being rotated by the rotating tie 34 in a direction that disengages the notches 176 and 177 from the ends 151 and 154 of the straps 148 and 149. Upon such disengagement, the tie clips 144 gravitationally slide downwardly along the sliding axis 152 in the direction of the arrow 274 in FIG. 9B, whereby the appropriate keys are engaged in the first slots 184 of the tie clips 144.

Figure 9C:
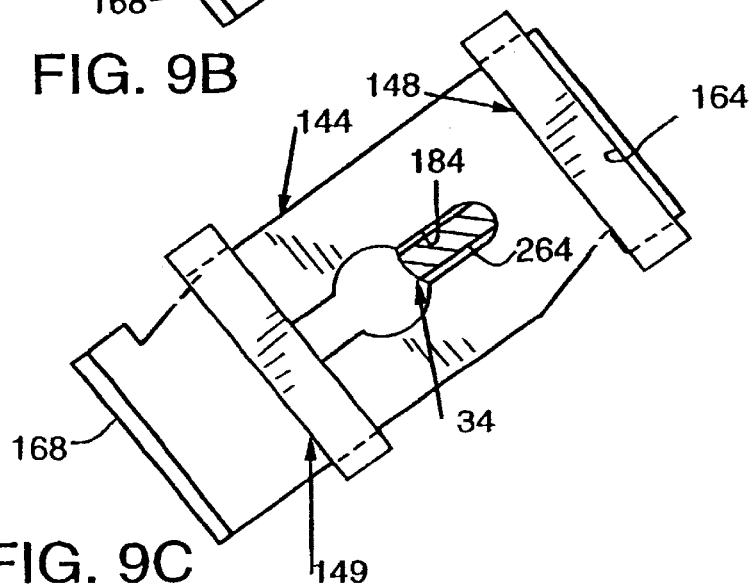
FIG. 9C is a view similar to FIG. 9B, except showing the retention structure fully received in the slot of the tie clip.

In receiving the tie 34 in the tie clips 144 as indicated above and as depicted generally in FIG. 9C, it can be seen that each of the first, second, and third keys 236, 240, and 244 has a first dimension, the key width 246, and a second dimension, the key length 248 which is defined by the outer diameter of the first end 204. The first dimension is less than the second dimension, as is evidenced by the first, second, and third grooves 224, 228, and 232 that define the key width 246. In this regard, it can be seen that the width of the first slot 184 in the tie plate 144 is greater than the first dimension (the key width 246) but is smaller than the second dimension (the key length 248), with the result that the keys can only be received in the first slot 184 in a given orientation, namely that depicted generally in FIG. C in which the longer dimension (the key length 248) is substantially aligned with the sliding axis 152. It can thus be seen that the configuration of the tie 34 to have first and second dimensions transverse to the central axis thereof permits the tie 34 to be manipulated such that a rotation of the tie 34 about its central axis to a given orientation results in both of the tie clips 144 simultaneously engaging desired keys of the tie 34. In this regard, it is understood that the first or smaller dimensions of the retention structures at the first end 204 are aligned with the first or smaller dimensions of the retention structures at the second end 208 to permit such simultaneous engagement with the tie clips 144. In this regard, it is further understood that the tie 34 may of numerous other configurations wherein the first and second dimensions may be perpendicular or non-perpendicular with one another, depending upon the specific needs of the particular application.

With one of the first, second, and third keys 236, 240, and 244 received in the first slot 184 of the tie clip 144 of the second clamping device 4, and with one of the first, second, and third keys 260, 264, and 268 received in the first slot 184 of the first clamping device 4, it can be seen that the opposed clamping devices 4 between which the tie 34 extends are retained in a fixed spatial relation with one another. More specifically, it can be seen that the clamping devices 4 cannot be moved closer to one another or be spread farther apart from one another due to the engagement of the keys and grooves in the first slots 184 of the tie clips 144. Readjustment could, however, be accomplished by disengaging the specific key from the first slot 184 of either or both of the tie clips 144 and re-engaging a different key therein.

The retention of the clamping devices 4 in a given spatial relationship with one another correspondingly retains the modular form members that are mounted on the clamping devices 4 in the same given spatial orientation. Such integrity in the orientation of the modular form members with respect to one another ensures that the resultant wall form 14 will remain in the desired configuration despite the hydrostatic forces that are inherent in the pouring and retention of concrete within the wall form 14.

While the insertion of only a single tie 34 between a pair of opposed clamping devices 4 has been set forth above, it is understood that in the embodiment depicted herein a pair of ties 34 extends between each opposite pair of clamping devices 4, and a plurality of clamping devices 4 typically are employed in assembling each of the interior and exterior structures 26 and 30 of the wall form 14. In this regard, it can be seen that the relatively simple operation set forth above, when repeated numerous times, saves substantial labor in assembling the wall form 14 as compared with assembling the wall form 14 with previously known wedge bolts in previously known tie members.

Once the wall form 14 has been completely assembled, as is generally shown in the example depicted in FIG. 1A, a building material such as uncured concrete is poured between the interior and exterior structures 26 and 30 of the wall form 14 to a desired height. In so doing, the ties 34 are generally submerged in the uncured concrete and thus will remain disposed within the concrete upon curing thereof. The tapered nature of the ties 34 nevertheless advantageously permits the ties 34 to be dislodged and removed from the wall after curing of the concrete.

More specifically, after the concrete has cured, the wall form 14 is disassembled by first removing the clamp bolts 96 from all of the first and second clamps 20 and 24, and by removing the modular form members 10 from the clamping devices 4. The clamping devices 4 are then removed from the cured concrete wall by first sliding each of the tie clips 144 along its sliding axis 152 until the hole 180 of each is aligned with the associated tie hole, which as depicted herein as the first tie hole 192. In this regard, the second ear 168 may need to receive a blow from a hammer or other appropriate tool to slide the tie clip 144 into such alignment. With the first and second clip assemblies 28 and 32 of each clamping device 4 aligned as such, the clamping devices 4 can be removed from the first and second ends 204 and 208 of the ties 34 that still protrude from the concrete wall.

After all of the clamping devices 4 and modular form members have been removed from the finished concrete wall, only the ties 34 remain, the ties 34 being disposed internally within the cured concrete wall and with the first and second ends 204 and 208 at least partially protruding from the wall. Inasmuch as the ties 34 are each advantageously tapered as set forth above, a blow from a hammer or other appropriate tool longitudinally applied to the first end 204 dislodges the tie 34 from the concrete wall and thus leaves a tapered circular hole in the concrete wall. The resultant hole can be sealed with caulking compounds or other appropriate sealants, or can be sealed by receiving a rubber-type plug in the hole to prevent leakage of water and undesirable matter.

The bar 16 is advantageously configured with a sufficient distance between the mounting and facing surfaces 80 and 84 that none of the grooves is ever disposed in the space between the interior and exterior structures 26 and 30 after construction of the wall form 14 is completed. In this regard, the distance between the first and third grooves 224 and 232, and the distance between the first and third grooves 250 and 256 is less than the distance between the mounting and facing surfaces 80 and 84, whereby the grooves are never exposed to the uncured concrete between the interior and exterior structures 26 and 30.

The clamping device 4 of the present invention thus quickly and easily permits the first and second modular form members 8 and 12 to be clamped on alternate sides thereof and to be clamped into a specific and fixed coplanar orientation with one another. The clamping device 4 also can receive a portion of a tie 34 therein such that the clamping device 4 can be held by the tie 34 in a fixed spatial relationship with an opposite clamping device 4. The ability of the tie 34 to cooperate with opposite clamping devices 4 provides a retention system that advantageously retains a modular form member of an interior structure in a fixed spatial relationship with an opposite modular form member in an exterior structure, which advantageously results in a finished concrete wall having vertical and evenly spaced interior and exterior walls if desired. The tie 34 is advantageously configured to have numerous grooves to allow the tie to be used in constructing walls of different thicknesses. Moreover, the configuration of the first and second clip assemblies 28 and 32 of each clamping device 4 permits a tie 34 to be installed between opposite clamping devices 4 by a laborer working only from the mounting surface 80 of either of the interior or exterior structures 26 or 30 of the wall form 14.

The configuration of the tie clips 144 to each slide along a sliding axis 152 that is oblique to the longitudinal axis 156 of the bar 16 permits the tie clips 144 to gravitationally engage portions of the ties 34. By configuring each of the tie clips 144 to have both a first slot 184 as well as a second slot 188 opposite thereto, the clamping devices 4 advantageously do not have a specific up or down configuration, meaning that the clamping devices 4 can be used in a given vertical orientation as well as an orientation where the same clamping device 4 is flipped upside-down. In the upside-down configuration, the second slots 188 of the tie clips 144 would engage the grooves and keys of the tie 34.

Figure 10:
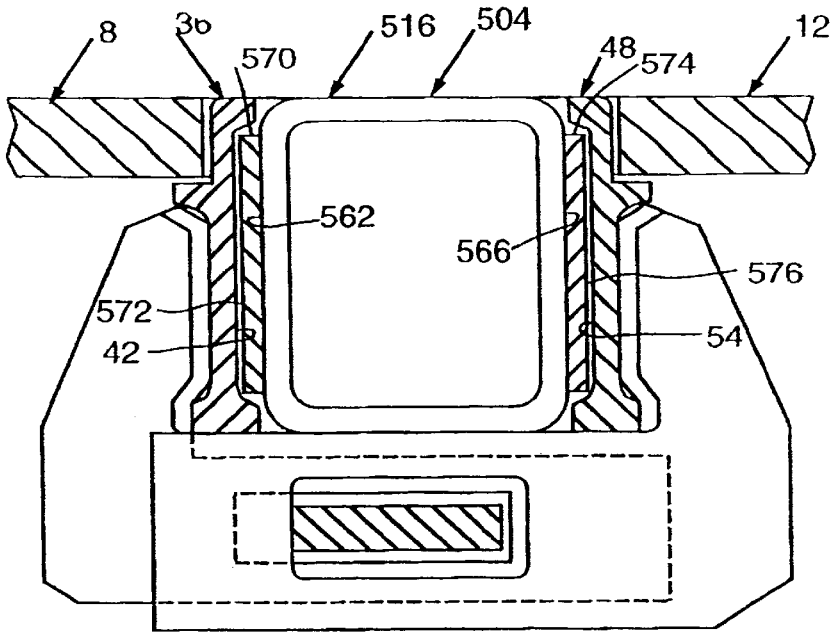
FIG. 10 is a view similar to FIG. 2, except depicting a second embodiment of a clamping device in accordance with the present invention.
Figure 11:
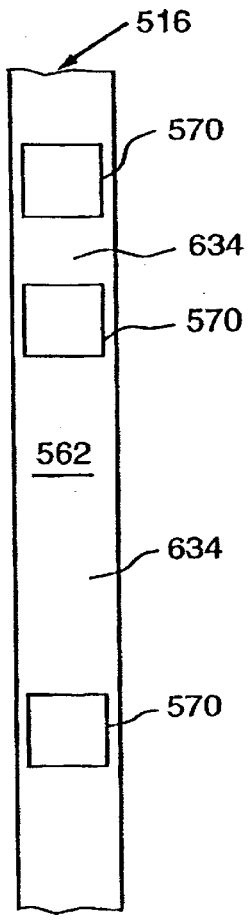
FIG. 11 is a left side elevational view of a portion of a bar of the second embodiment.
Figure 12:
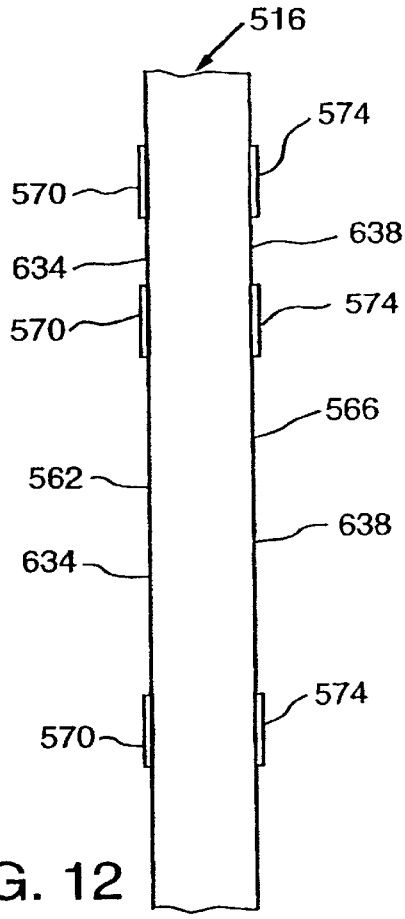
FIG. 12 is a front elevational view of the portion of the bar of the second embodiment.

A second embodiment of a clamping device 504 in accordance with the present invention is indicated generally in FIGS. 10–12. The clamping device 504 is similar to the clamping device 4, except that the bar 516 is of a different configuration than the bar 16. More specifically, the bar 516 is a substantially hollow member having a first surface 562 and a second surface 566 opposite one another, the first surface 562 having a plurality of first pads 570 thereon, and the second surface 566 having a plurality of second pads 574 thereon.

It can be seen that the first pads 570 together operate as a first protrusion 572, and the second pads 574 operate together as a second protrusion 576, the first and second protrusions 572 and 576 extending outwardly from opposite sides of the bar 516. It can likewise be seen that the first protrusion 572 providing by the first pads 570 is clampingly receivable in the first indentation 42 of the first perimeter frame 36 of the first modular form member 8, and that the second protrusion 576 provided by the second pads 574 is clampingly receivable in the second indentation 54 of the second modular form member 12.

The first and second pads 570 and 574 may be made of the same material as the bar 516 or may be made out of a different material. The first and second pads 570 and 574 are mounted on the bar 516 using any of a variety of known methods such as by welding, adhering, fastening with fasteners, and other appropriate mounting methodologies. It is further noted that the first and second pads 570 and 574 can be integrally formed in the bar 516, such as by embossing the first and second pads 570 and 574 on the bar 516, by forming the bar 516 and the first and second pads 570 and 574 together as a monolithic structure, or by employing other appropriate forming methodologies.

The first pads 570 are longitudinally spaced from one another along the first surface 562 to provide a number of first gaps 634 extending therebetween. The second pads 574 are similarly spaced along the second surface 566 to provide second gaps 638 therebetween. The first and second gaps 634 and 638 advantageously can receive a nominal quantity of foreign matter therein to resist interference by the foreign matter with attachment of the first and second modular form members 8 and 12 to the clamping device 504 and alignment therebetween. It is understood, however, that in other configurations the bar 516 may include only a single first pad 570 extending substantially along the longitudinal extent thereof, and similarly may include a single second pad 574 extending along the longitudinal extent thereof, without departing from the concept of the present invention.

The configuration of the bar 516 thus provides the advantages of readily clamping and aligning the first and second modular form members 8 and 12 thereto, and provides versatility in the way that the first and second pads 570 and 574 may be formed. The configuration of the bar 516 with its first and second pads 570 and 574 thus potentially may be manufactured less expensively than the bar 16 under various circumstances.

Figure 13:
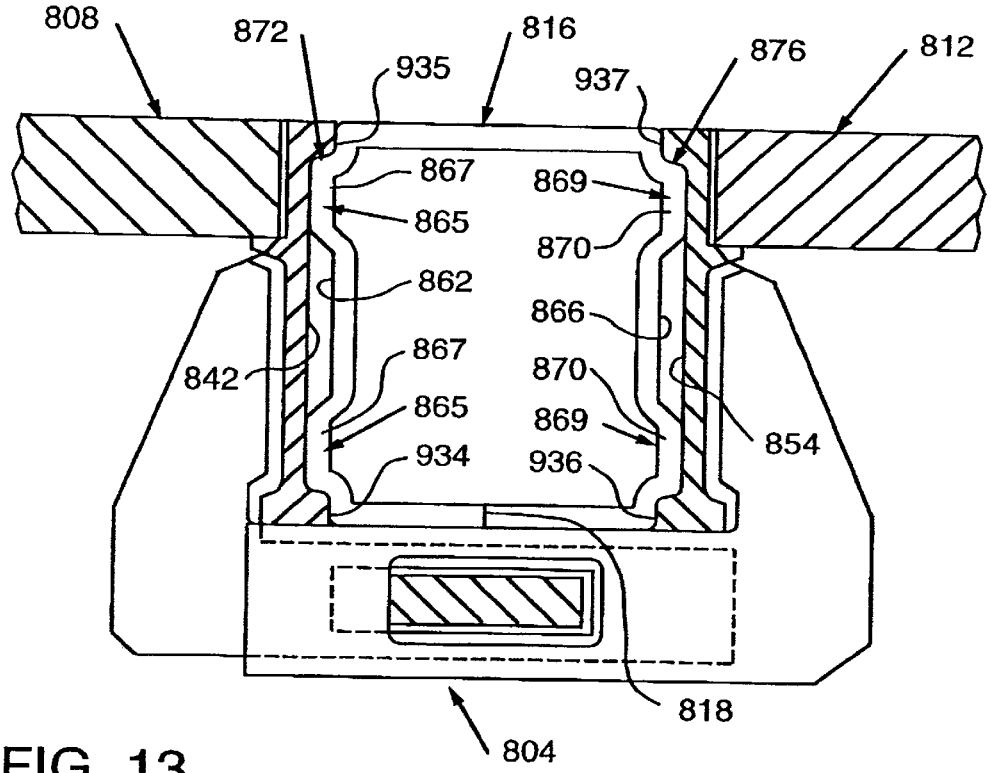
FIG. 13 is a view similar to FIG. 2, except depicting a third embodiment of a clamping device in accordance with the present invention.
Figure 14:
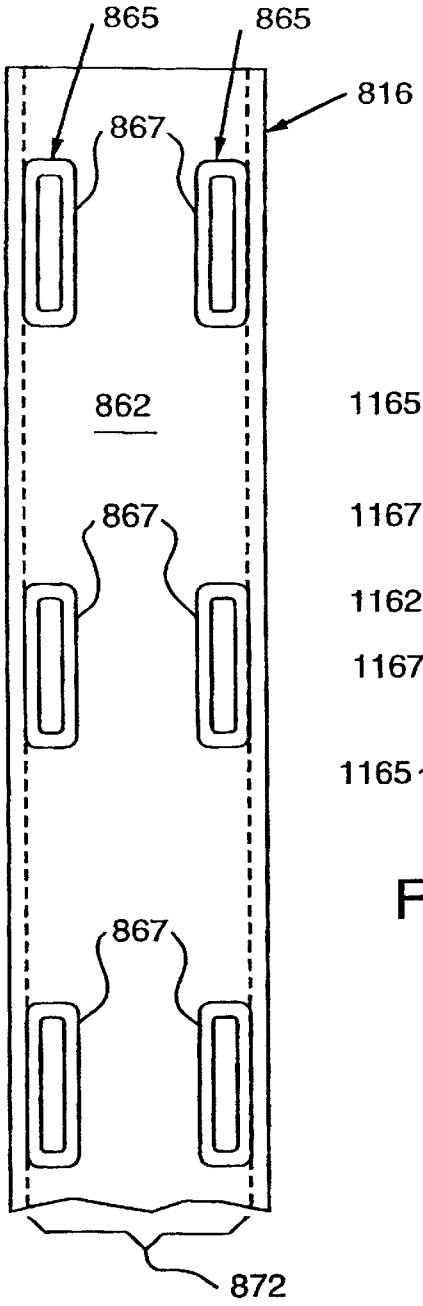
FIG. 14 is a side elevational view of a bar of the third embodiment.

A third embodiment of a clamping apparatus 804 in accordance with the present invention is indicated generally in FIGS. 13 and 14. The clamping apparatus 804 includes a bar 816 that is removably clamped between first and second modular form members 808 and 812 in a fashion similar to the operation of the clamping apparatus 4. The bar 816 advantageously includes a pair of first bump members 865 extending outwardly from a first surface 862 of the bar 816 that together form the first protrusion 872. Similarly, the bar 816 includes a pair of second bump members 869 extending outwardly from a second surface 866 of the bar 816 opposite the first surface 862 to form the second protrusion 876.

As is best shown in FIG. 14, each first bump member 865 includes a plurality of first bumps 867 that are spaced from one another and are aligned with one another along the length of the bar 816. The first bumps 867 are thus arranged in a pair of parallel and spaced apart first rows to form the first bump members 865. It is further understood from FIG. 13 that the second bump members 869 are each similarly made up of a plurality of second bumps 870 that are configured and arranged to be substantially similar to the first bumps 867.

As is best shown in FIG. 13, the first bump members 865 engage the first extension members 934 and 935 of the first modular form member 808. More specifically, one set of the first bumps 867 engages the fillet of the first extension member 934, and the other set of first bumps 867 engages the fillet of the first extension member 935. The second bumps 870 similarly engage the second extension members 936 and 937. It thus can be seen that the first protrusion 872 formed by the first bump members 865 is removably engagable with the first indentation 842, of the first modular form member 808 and that the second protrusion 876 formed by the second bump members 869 is engagable in the second indentation 854 of the second modular form member 812.

As can be seen from FIGS. 13 and 14, the first and second bump members 865 and 869 are depicted as being formed in the bar 816 such as by roll forming, embossing, stamping, or otherwise forming the first and second bumps 867 and 870 into the bar 816. In this regard, it is noted that the bar 816 depicted in FIG. 13 includes a joint 818 formed by the abutting sides of a sheet of material out of which the bar is made, although the bar 816 may be manufactured in other fashions that do not involve the formation of the joint 818.

It is further understood that the first and second bump members 865 and 869 may, in other embodiments, extend continuously along the length of the bar 816, and may be of other configurations than that depicted generally in FIGS. 13 and 14. It is further understood that the first and second bump members 865 and 869 can be in the form of structures that are disposed on the bar 16, as will be set forth more fully below.

The configuration of the bar 816 with first and second bumps 867 and 870 that engage the fillets of the first and second modular form members 808 and 812 provides engagement structures that are limited in size yet permit secure retention of the first and second modular form members 808 and 812 on the bar 816, and further provides larger cavities therebetween into which foreign matter can be received to avoid interference with the clamping function of the clamping apparatus 804. Moreover, the first and second bump members 865 and 869 can be of numerous different configurations which adds a great level of versatility to the clamping apparatus 804 by permitting it to be manufactured in different ways and by making it suitable for use in diverse applications.

Figure 15:
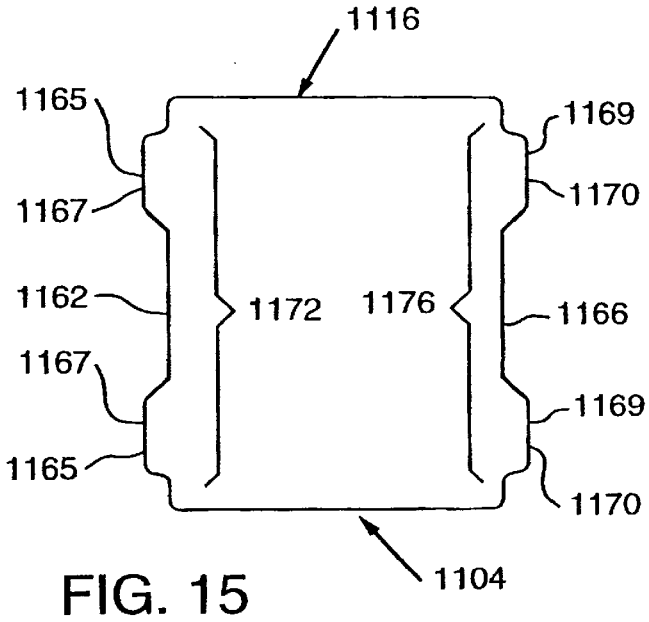
FIG. 15 is a cross-sectional view of a bar of a fourth embodiment of a clamping device in accordance with the present invention.

A fourth embodiment of a clamping apparatus 1104 in accordance with the present invention is indicated generally in FIG. 15. The clamping apparatus 1104 includes a substantially solid bar 1116 having a pair of first bump members 1165 extending outwardly from a first surface 1162 of the bar 1116 and a pair of second bump members 1169 extending outwardly from a second surface 1166 of the bar 1116 opposite the first surface 1162. The first and second bump members 1165 and 1169 are formed integrally and monolithically with the bar 1116 as a single structure. The first bump members 1165 form a first protrusion, and the second bump members 1169 form a second protrusion 1176. The first and second protrusions 1172 and 1176 are engagement structures that are removably engagable with complementary structures on modular form members in a fashion similar to the clamping apparatus 804.

The first bump members 1165 are each in the form of a first bump 1167 that extends continuously along the length of the bar 1116, and the second bump members 1169 are each similarly in the form of a second bump 1170 extending continuously along the length of the bar 1116. As such, the cross-section of the bar 1116 is substantially constant throughout the longitudinal extent of the bar 1116. In other embodiments, however, the first and second bump members 1165 and 1169 may be non-continuous in a fashion similar to the bar 816.

Since the first and second bumps 1167 and 1170 are formed integrally and monolithically with the bar 1116 as a single structure, the bar 1116 can be manufactured by known methods such as extrusion and the like. In embodiments of the bar 1116 such as that depicted in FIG. 15 in which the bar 1116 is not formed with a space extending throughout the longitudinally extent thereof, the bar 1116 may be manufactured out of a relatively lightweight material such as a plastic foam combined with a strengthening matrix such as fibers of glass, carbon, or aramid, although numerous other appropriate materials may be employed without departing from the concept of the present invention. Moreover, the bar 1116 may also be formed with a space (not shown) extending partially or fully along the longitudinal extent thereof depending upon considerations of strength, weight, and conservation of the materials, as well as other considerations. It is further understood that the bar 1116 could be manufactured out of metal depending upon the above considerations and the requirements of the application. It thus can be seen that the clamping apparatus 1104 provides additional versatility by permitting the bar 1116 to be configured in additional diverse ways and manufactured out of different types of materials.

Figure 16:
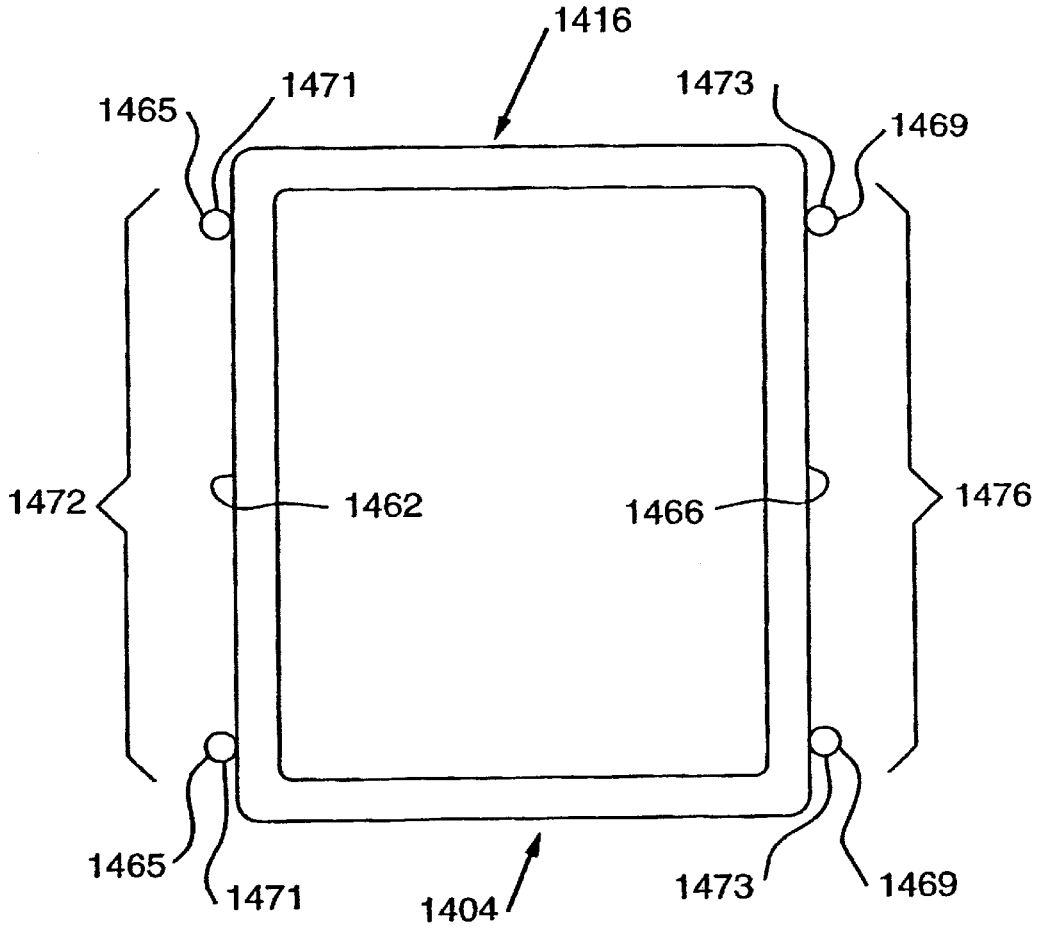
FIG. 16 is a cross-sectional view of a bar of a fifth embodiment of a clamping device in accordance with the present invention.

A fifth embodiment of a clamping apparatus 1404 of the present invention is depicted generally in FIG. 16. The clamping apparatus 1404 includes an elongated bar 1416 having a pair first bump members 1465 disposed on a first surface 1462 of the bar 1416 and a pair of second bump members 1469 disposed on a second surface 1466 of the bar 1416 opposite the first surface 1462. It can be understood from FIG. 16 that each first bump member 1465 is in the form of an elongated first rod 1471 that is fixedly mounted on the first surface 1462 by welding, adhesion, fastening with fasteners, or by other appropriate attachment methodologies. Similarly, each second bump member 1469 is in the form of an elongated second rod 1473 that is similarly mounted on the second surface 1466. The first rods 1471 thus together form the first protrusion 1472, and the second rods 1473 together form the second protrusion 1476.

The first and second rods 1471 and 1473 are each advantageously configured with an arcuate outer surface that is configured to engage a fillet of and extension member of a modular form member. If the fillets of the modular form members are themselves arcuate, the curvature of the first and second rods 1471 and 1473 preferably is configured to match the curvature of the fillets, or to at least be of a smaller radius than the fillets to permit engagement therebetween. If the fillets are angled, the first and second rods 1471 and 1473 still provide appropriate engagement structures that can engage the modular form members and resist movement between the modular form members and the bar 1416.

While the first and second bump members 1465 and 1469 are depicted as being of a substantially circular cross-section, it is understood that in other configurations the cross-sections may be of other configurations such as portions of circles, non-circular arcuate shapes, and polygonal shapes, as well as other shapes, without departing from the concept of the present invention. Moreover, while the first and second rods 1471 and 1473 are depicted herein as being substantially continuous along the longitudinal extent of the bar 1416, it is understood that in other embodiments the first and second rods 1471 and 1473 may be discontinuous in a fashion similar to the first and second bumps 867 and 870 of the bar 816. It is further understood that in still other embodiments the first and second bump members 1465 and 1469 may be integrally formed in a monolithic fashion with the bar 1416 as a single structure or may be formed thereon in other appropriate fashions.

The first and second modular form members 8 and 12, and the modular form member 10 generally, are of various dimensions suited to the construction of concrete walls of buildings and other structures. As such, an example of the nominal dimensions of one instance of the first and second modular form members 8 and 12 and the modular form member 10 are approximately two feet in width and eight feet in height. It is understood, however, that other instances of the modular form members may be of numerous different dimensions that can be assembled in various combinations and orientations to provide a wall form 14 having specific desired dimensions to result in a finished concrete wall having the desired dimensions.

In this regard, it is understood that the method and apparatus of the present invention can be used to construct walls out of a building material such as concrete in commercial, industrial, residential, and public works applications, as well as other appropriate applications. While concrete is illustrated herein as being the building material that is employed with the method and apparatus of the present invention, it can be seen that other appropriate building materials potentially may be employed to create other types of walls without departing from the concept of the present invention.

While a number of particular embodiments of the present invention have been described herein, it is understood that various changes, additions, modifications, and adaptations may be made without departing from the scope of the present invention, as set forth in the following Claims.

What is claimed is:

1. A retention system for retaining a first modular form member in a given orientation with respect to a second modular form member, the first modular form member being formed with a first indentation, the second modular form member being formed with a second indentation, the retention system comprising:

a first clamping device;

a second clamping device; and an elongated tie;

the first clamping device including a first elongated bar having at least a first protrusion, at least a first clamp, and at least a first tie clip, the at least first protrusion being structured to be engageable with the first indentation, the at least first clamp having a jaw, the jaw of the at least first clamp being structured to removably engage the first protrusion with the first indentation, the at least first tie clip being mounted on the first bar and being formed with an opening that is configured to removably receive at least a portion of the tie therein; and the second clamping device including a second elongated bar having at least a second protrusion, at least a second clamp, and at least a second tie clip, the at least second protrusion being structured to be engageable with the second indentation, the at least second clamp having a jaw, the jaw of the at least second clamp being structured to removably engage the second protrusion with the second indentation, the at least second tie clip being mounted on the second bar and being formed with an opening that is configured to removably receive at least a portion of the tie therein.

2. The retention system of claim 1, in which the first and second bars are each formed with at least a first tie hole extending therethrough and include a mounting surface, the at least first clamp and tie clip being mounted on the mounting surface of the first bar, the at least second clamp and tie clip being mounted on the mounting surface of the second bar, the tie being removably receivable in the at least first tie holes of the first and second bars and being removably receivable in the openings of the at least first and second tie clips.

3. The retention system of claim 2, in which the openings formed in the at least first and second tie clips each include at least a first slot, and in which the tie has a first end and a second end, each of the first and second ends being formed with at least a first retention structure, the at least first retention structure of the first end being removably receivable in the at least first slot of the at least first tie clip, the at least first retention structure of the second end being removably receivable in the at least first slot of the at least second tie clip.

4. The retention system of claim 3, in which the tie is tapered inwardly along at least a portion thereof between the first and second ends.

5. The retention system of claim 3, in which each of the at least first retention structures includes a first groove.

6. The retention system of claim 3, in which each of the first and second ends is formed with a second retention structure, the second retention structures being longitudinally spaced along the tie from the first retention structures, the second retention structures being removably receivable in the slots of the at least first and second tie clips.

7. The retention system of claim 3 in which the at least first tie clip is movably mounted on the first bar, and in which the at least second tie clip is movably mounted on the second bar.

8. The retention system of claim 7, in which the at least first tie clip is slidably mounted on the first bar, the at least first tie clip being slidable along a first sliding axis that is non-parallel with a longitudinal axis of the first bar, and in which the at least second tie clip is slidably mounted on the second bar, the at least second tie clip being slidable along a second sliding axis that is non-parallel with a longitudinal axis of the second bar.

9. The retention system of claim 8, in which the openings formed in the at least first and second tie clips each include a second slot opposite the at least first slot, the at least first retention structures being removably receivable in the second slots.

10. The retention system of claim 8, in which the at least first tie clip is pivotably mounted on the first bar, and in which the at least second tie clip is pivotably mounted on the second bar.

11. The retention system of claim 10, in which a first strap member movably retains the first tie clip on the first bar, the first tie clip being formed with a first notch, the first strap member being removably receivable in the first notch of the first tie clip, and in which a second strap member movably retains the second tie clip on the second bar, the second tie clip being formed with a first notch, the second strap member being removably receivable in the first notch of the second tie clip.

12. The retention system of claim 11, in which the first and second tie clips each include a second notch opposite the first notch.

13. The retention system of claim 11, in which the first strap member includes a pair of first straps, and in which the second strap member includes a pair of second straps.

* * * * *